US007330167B2

(12) United States Patent
Sakata et al.

(10) Patent No.: US 7,330,167 B2
(45) Date of Patent: Feb. 12, 2008

(54) METHOD FOR DRIVING A DISPLAY PANEL

(75) Inventors: Kazuaki Sakata, Yamanashi-ken (JP); Hideto Nakamura, Yamanashi-ken (JP); Hideki Tanaka, Yamanashi-ken (JP); Yoshichika Sato, Yamanashi-ken (JP); Tsutomu Tokunaga, Yamanashi-ken (JP); Mitsushi Kitagawa, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 631 days.

(21) Appl. No.: 10/893,219

(22) Filed: Jul. 19, 2004

(65) Prior Publication Data

US 2005/0017961 A1 Jan. 27, 2005

(30) Foreign Application Priority Data

Jul. 22, 2003 (JP) ..... 2003-199874

(51) Int. Cl.
*G09G 5/00* (2006.01)

(52) U.S. Cl. ..... 345/67; 345/204

(58) Field of Classification Search ..... 345/67, 345/68, 60, 208, 204
See application file for complete search history.

(56) References Cited

U.S. PATENT DOCUMENTS 6,784,857 B1 * 8/2004 Nakamura ..... 345/60
6,803,888 B1 * 10/2004 Nakamura et al. ..... 345/60
6,876,343 B2 * 4/2005 Myoung et al. ..... 345/67
6,903,514 B2 * 6/2005 Yun et al. ..... 315/169.4
6,922,180 B2 * 7/2005 Iwami et al. ..... 345/60
7,012,579 B2 * 3/2006 Choi ..... 345/60

FOREIGN PATENT DOCUMENTS

JP 2000-155557 6/2000

* cited by examiner

*Primary Examiner*—Amare Mengistu
*Assistant Examiner*—Afroza Y Chowdhury
(74) *Attorney, Agent, or Firm*—Drinker Biddle & Reath LLP

(57) ABSTRACT

In order to provide a method for driving a display panel capable of improving durability of a driving device for driving a display panel, when a scan pulse is applied in superposition with a base pulse to one of row electrodes of one row electrode pair among row electrode pairs while the base pulse is applied to one of the row electrodes of all the row electrode pairs in the display panel and a pixel data pulse corresponding to an image signal is applied to the row electrode at the same timing as that of the scan pulse to set discharge cells to either one of a light-on mode and a light-off mode, a change ratio of a voltage value in a fall period in the base pulse is smaller than a change ratio of a voltage value in a fall period in the scan pulse.

2 Claims, 7 Drawing Sheets

METHOD FOR DRIVING A DISPLAY PANEL

BACKGROUND OF THE INVENTION

1. Field of the Invention

The present invention relates to a method for driving a display panel.

2. Description of the Related Art

A display device having a plasma display panel mounted thereto as the display panel described above is described in JP-A-2000-155557, for example.

FIG. 1 shows a schematic construction of such a display device.

Referring to FIG. 1, a PDP 1 as the plasma display panel includes row electrodes Y1 to Yn and row electrodes X1 to Xn corresponding to rows (first to nth rows) of one screen, whereby each X and each Y form a pair. Column electrodes D1 to Dm are formed in such a fashion as to correspond columns (first to m-th columns) of one screen and to intersect these row electrodes. In this instance, a discharge cell as a capacitive light emitting device is formed at a point of intersection between one set of row electrode pair and one column electrode. An address driver 2 converts pixel data for each pixel based on an image signal to a pixel data pulse having a voltage value corresponding to a logic level of the pixel data and applies the pixel data pulse to the column electrodes D1 to Dm for each row. An X-row electrode driver 3 generates a reset pulse for initializing a residual wall charge quantity of each discharge cell and a sustain discharge pulse for sustaining a discharge light emission state of each light-on mode discharge cell to be later described and applies these pulses to the row electrodes X1 to Xn. A Y-row electrode driver 4 generates a reset pulse for initializing the residual wall charge quantity of each discharge cell and the sustain discharge pulse for sustaining the discharge light emission state of each light-on mode discharge cell and applies these pulses to the row electrodes Y1 to Yn in the same way as the X-row electrode driver 3. The Y-row electrode driver 4 further generates a priming pulse for re-forming charge particles generated inside the discharge cells and a scan pulse SP for causing each discharge cell to generate a quantity of charge corresponding to the pixel data pulse and for setting the light-on mode discharge cell or light-off mode discharge cells, and applies these pulses to the row electrodes Y1 to Yn.

FIG. 2 shows an internal construction of the X-row electrode driver 3 and the Y-row electrode driver 4. Incidentally, an electrode X1 in FIG. 2 represents an electrode of a j-th row among the electrodes X1 to Xn and an electrode Yj represents an electrode of a j-th row among the electrodes Y1 to Yn.

The X-row electrode driver 3 includes two power sources B1 and B2. The power source B1 outputs a voltage Vs1 (for example, 170 V) and the power source B2 outputs a voltage Vr1 (for example, 190 V). A positive terminal of the power source B1 is connected to a connection line 11 for the electrode Xj through a switching device S3 and its negative terminal is grounded. A switching device S4 is interposed between the connection line 11 and the earth. In addition, a series circuit including a switching device S1, a diode D1 and a coil L1 and a series circuit including a coil L2, a diode D2 and a switching device S2 are interposed between the connection line 11 and the earth through a capacitor C1 interposed on the earth side. Incidentally, the diode D1 is connected with its anode positioned on the side of the capacitor C1 and the diode D2, with its cathode positioned on the side of the capacitor C1. A positive terminal of the power source B2 is connected to the connection line 11 through a switching device S8 and a resistor R1 and its negative terminal is grounded. The Y-row electrode driver 4 includes four power sources B3 to B6. The power source B3 outputs the voltage Vs1 (for example, 170 V) and the power source B4 outputs the voltage Vr1 (for example, 190 V). The power source B5 outputs a voltage Voff (for example, 140 V) and the power source B6 outputs a voltage Vh (for example, 160 V, Vh>Voff). A positive terminal of the power source B3 is connected to a connection line 12 for a switching device 15 through a switching device S13 and its negative terminal is grounded. A switching device S14 is interposed between the connection line 12 and the earth. In addition, a series circuit including a switching device S11, a diode D3 and a coil L4 and a series circuit including a coil L4, a diode D4 and a switching device S12 are interposed between the connection line 12 and the earth through a capacitor C2 interposed on the earth side. Incidentally, the diode D3 is connected with its anode positioned on the side of the capacitor C2 and the diode D4, with its cathode positioned on the side of the capacitor C2. The connection line 12 is connected to a connection line 13 for a positive terminal of the power source B6 through a switching device S15. A positive terminal of the power source B4 is grounded and its negative terminal is connected to the connection line 13 through a switching device S16 and a resistor R2. A positive terminal of the power source B5 is connected to the connection line 13 through a switching device S17 and is negative terminal is grounded. The connection line 13 is connected to a connection line 14 for the electrode Yj through a switching device S21. A negative terminal of the power source B6 is connected to the connection line 14 through a switching device S22. A diode D5 is interposed between the connection lines 13 and 14 and a series circuit of a switching device S23 and a diode D6 is interposed between these connection lines 13 and 14, too. The diode D5 is connected with its anode positioned on the side of the connection line 14 and the diode D6, with its cathode positioned on the side of the connection line 14.

Here, a control circuit, not shown in the drawings, controls ON/OFF switching of the switching devices S1 to S4, S8, S11 to S17 and S21 to S23.

Incidentally, the power source B3, the switching devices S11 to S15, the coil L3, the coil L4, the diode D3, the diode D4 and the capacitor C2 constitute a sustain driver portion inside the Y-row electrode driver 4. The power source B4, the resistor R2 and the switching device S16 constitute a reset driver portion. The power source B5, the power source B6, the switching device S13, the switching device S17, the switching device S21, the switching device S22, diode D5 and D6 constitute a scan driver portion.

Next, operations under such a construction will be explained with reference to the timing chart of FIG. 3.

Driving of the PDP 1 is divided into a reset period, an address period and a sustain period as shown in FIG. 3.

First, in the reset period, the switching device S23 of the Y-row electrode driver 4 is turned ON. The switching device S23 remains ON during the reset period and the sustain period. At the same time, the switching device S8 of the X-row electrode driver 3 is turned ON and the switching device 16 of the Y-row electrode driver 4 is turned ON. Other switching devices are OFF. As the switching device S8 is turned ON, current flows from the positive terminal of the power source B2 into the electrode Xj through the switching device S8 and the resistor R1. As the switching device S16 is turned ON, current flows from the electrode Yj into the negative terminal of the power source B4 through the diode D5, the resistor R2 and the switching device S16. In this instance, the potential of the electrode Xj gradually rises depending on the time constant of the load capacitance C0 of the PDP 1 and the resistor R1 and a reset pulse RPx shown in FIG. 3 is generated. On the other hand, the potential of the electrode Yj gradually decrease depending on the time constant of the load capacitance C0 and the resistor R2 and a reset pulse RPy shown in FIG. 3 is generated. The reset pulse RPx is simultaneously applied to all the electrodes X1 to Xn and the reset pulse RPy is simultaneously applied to all the electrodes Y1 to Yn. Because of the simultaneous application of these reset pulses RPx and RPy, reset discharge is induced inside all the discharge cells of the PDP 1 and after this discharge finishes, wall charge of a predetermined quantity is uniformly formed in the dielectric layer of all the discharge cells. The switching devices S8 and S16 are turned OFF after the levels of the reset pulses RPx and RPy get into saturation but before the end of the reset period. At this point, the switching devices S4, S14 and S15 are turned ON and both of the electrodes Xj and Yj are grounded. Consequently, the reset pulses RPx and RPy disappear.

Next, in the address period, the switching devices S14 and S15 are turned OFF, the switching device S23 is turned OFF, the switching device S17 is turned ON and at the same time, the switching device S22 is turned ON. As the switching device S17 is turned ON, the power source B5 and the power source B6 enter a series connection state and a negative potential representing the difference between the voltages Vh and Voff occurs at the negative terminal of the power source B6 and is applied to the electrode Yj. In this address period, the address driver 2 converts pixel data for each pixel based on the image signal to each pixel data pulse DP1 to DPn having a voltage value corresponding to the logic level of the pixel data and serially applies it to the column electrodes D1 to Dm for each row. As shown in FIG. 3, the pixel data pulses DPj and DPj+1 are applied to the electrodes Yj and Yj+1. In the mean time, the Y-row electrode driver 4 serially applies the priming pulse PP of the positive voltage to the row electrodes Y1 to Yn and serially applies the scan pulse SP of the negative voltage in synchronism with the timing of the group of the pixel data pulses DP1 to DPn immediately after the application of each priming pulse PP. The explanation will be given on the electrode Yj. When the priming pulse PP is generated, the switching device S21 is turned ON and the switching device S22 is turned OFF. The switching device S17 remains OFF. Consequently, the potential Voff of the positive terminal of the power source B5 is applied as the priming pulse PP to the electrode Yj through the switching device S17 and then through the switching device S21. After the priming pulse PP is applied, the switching device S21 is turned OFF in synchronism with the application of the pixel data pulse DPj from the address driver 2 and the switching device S22 is turned ON. Accordingly, the negative potential representing the difference between the voltage Vh of the negative terminal of the power source B6 and Voff is applied as the scan pulse SP to the electrode Yj. The switching device S21 is turned ON in synchronism with the stop of the application of the pixel data pulse DPj from the address driver 2, the switching device S22 is turned OFF and the potential Voff of the positive terminal of the power source B5 is applied to the electrode Yj through the switching device S17 and then through the switching device S21. As for the electrode Yj+1, too, the priming pulse PP is thereafter applied in the same way as the electrode Yj and the scan pulse SP is applied in synchronism with the application of the pixel data pulse DPj+1 from the address driver 2. Among the discharge cells belonging to the row electrodes to which the scan pulse SP is applied, discharge occurs inside those discharge cells to which the pixel data pulse of the positive voltage is further applied simultaneously, and the majority of their wall discharge is lost. On the other hand, discharge does not occur in the discharge cells to which the scan pulse SP is applied but the pixel data pulse of the positive voltage is not applied and the wall charge remains as such. In this instance, the discharge cells in which the wall charge remains are light-on mode discharge cells and the discharge cells in which the wall charge disappears are light-off mode discharge cells. In the shift from the address period to the sustain period, the switching devices S17 and S21 are turned OFF. Instead, the switching devices S14 and S15 are turned ON. The ON state of the switching device S4 is kept.

Next, in the sustain period, the potential of the electrode Xj reaches the earth potential of about 0 V as the switching device S4 of the X-row electrode driver 3 is turned ON. Next, when the switching device S4 is turned OFF and the switching device S1 is turned ON, current reaches the electrode Xj due to the charge stored in the capacitor C1 through the coil L1, the diode D1 and the switching device S1 and charges the load capacitance C0 of the PDP 1. At this time, the potential of the electrode Xj gradually rises depending on the time constant of the coil L1 and the load capacitance C0. Next, the switching device S1 is turned OFF and the switching device S3 is turned ON. Consequently, the potential Vs1 of the positive terminal of the power source B1 is applied to the electrode Xj. The switching device S3 is thereafter turned OFF, the switching device S2 is turned ON and the current flows from the electrode Xj into the capacitor C1 due to the charge stored in the load capacitance C0 through the coil L2, the diode D2 and the switching device S2. At this time, the potential of the electrode j gradually decrease depending on the time constant of the coil L2 and the capacitor C1 as shown in FIG. 3. When the potential of the electrode Xj substantially reaches 0 V, the switching device S2 is turned OFF and the switching device S4 is turned ON. Due to such an operation, the X-row electrode driver 3 applies the sustain discharge pulse IPx of the positive voltage shown in FIG. 3 to the electrode Xj. At the ON time of the switching device S4 at which the sustain discharge pulse IPx disappears, the switching device S11 is simultaneously turned ON and the switching device S14 is turned OFF in the Y-row electrode driver 4. When the switching device S14 remains OFF, the potential of the electrode Yj is at the earth potential of about 0 V but when the switching device S14 is turned OFF and the switching device S11 is turned ON, the current reaches the electrode Yj due to the charge stored in the capacitor C2 through the coil L3, the diode D3, the switching device S11, the switching device S15, the switching device S13 and the diode D6 and charges the load capacitance C0 of the PDP 1. At this time, the potential of the electrode Yj gradually rises as shown in FIG. 3 depending on the time constant of the coil L3 and the load capacitance C0. Next, the switching device S11 is turned OFF and the switching device S13 is turned ON. Consequently, the potential VS1 of the positive terminal of the power source B3 is applied to the electrode Yj. Thereafter the switching device S13 is turned OFF, the switching device S12 is turned ON and the current flows from the electrode Yj into the capacitor C2 due to the charge stored in the load capacitance C0 through the diode D5, the switching device S15, the coil L4, the diode D4 and the switching device S12. At this time, the potential of the electrode Yj gradually decrease depending on the time constant of the coil L4 and the capacitor C2 as shown in FIG. 3. When the potential of the electrode Yj substantially reaches 0 V, the switching device S12 is turned OFF and the switching device S14 is turned ON. Due to such an operation, the Y-row electrode driver 4 applies the sustain discharge pulse IPy of the positive voltage shown in FIG. 3 to the electrode Yj.

Whenever the sustain discharge pulses IPx and IPy are applied in this way to the electrodes X1 to Xn and to the electrodes Y1 to Yn during the sustain period, the light-on mode discharge cells in which the wall charge remains repeat discharge light emission and keep the light emission state.

In driving shown in FIG. 3, however, the voltages of all the row electrodes Y sharply shift all at once to 0 V during the shift from the address period to the sustain period and noise occurs. In this instance, a large current resulting from such a noise flows in some cases into the driver IC and may invite the drop of IC's life.

The invention is completed to solve such problems and aims at providing a driving method of a display panel capable of improving durability of a driving device for driving the display panel.

SUMMARY OF THE INVENTION

The invention provides a method for driving a display panel having discharge cells arranged at points of intersection between a plurality of row electrode pairs corresponding to display lines and a plurality of column electrodes so arranged as to intersect the row electrode pairs, for each of a plurality of sub-fields constituting each field of an image signal, wherein each of the sub-fields includes an address period in which a scan pulse is applied in superposition with a base pulse to one of the row electrodes of one of the row electrode pairs while the base pulse is applied to one of the row electrodes of all of the row electrode pairs, and the discharge cells are selectively caused to discharge and are set to either one of a light-on mode and a light-off mode by applying a pixel data pulse corresponding to the image signal at the same application time as that of the scan pulse, and a sustain period in which a sustain pulse is applied the number of times corresponding to weighting of the sub-field to the row electrode pairs so that only the discharge cells set to the light-on mode are allowed to repeatedly cause sustain discharge; and a change ratio of a voltage value in a fall period of the voltage value in the base pulse is smaller than a change value of a voltage value in a fall period in the scan pulse.

DETAILED DESCRIPTION OF THE INVENTION

Preferred embodiments of the invention will be hereinafter explained in detail with reference to the accompanying drawings.

Figure 1:
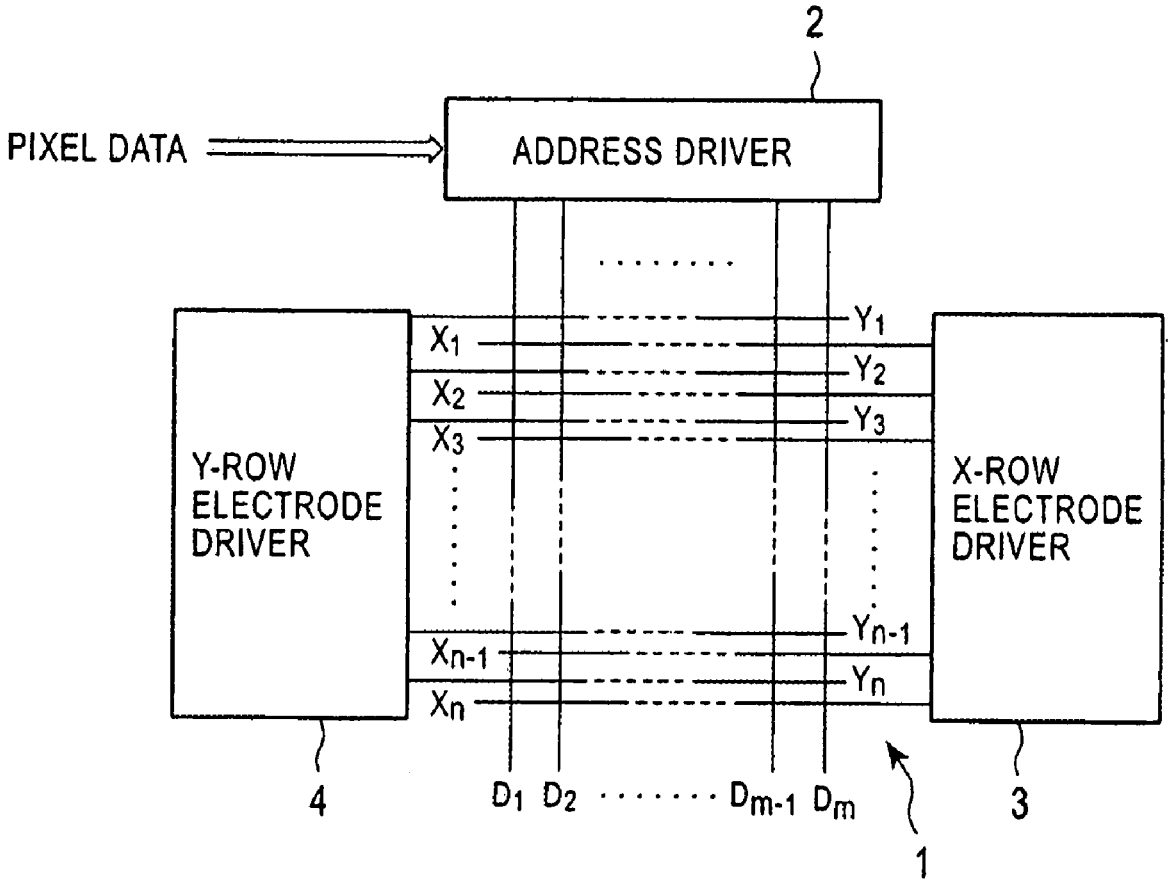
PRIOR ART FIG. 1
FIG. 1 shows a schematic construction of a plasma display device.
Figure 2:
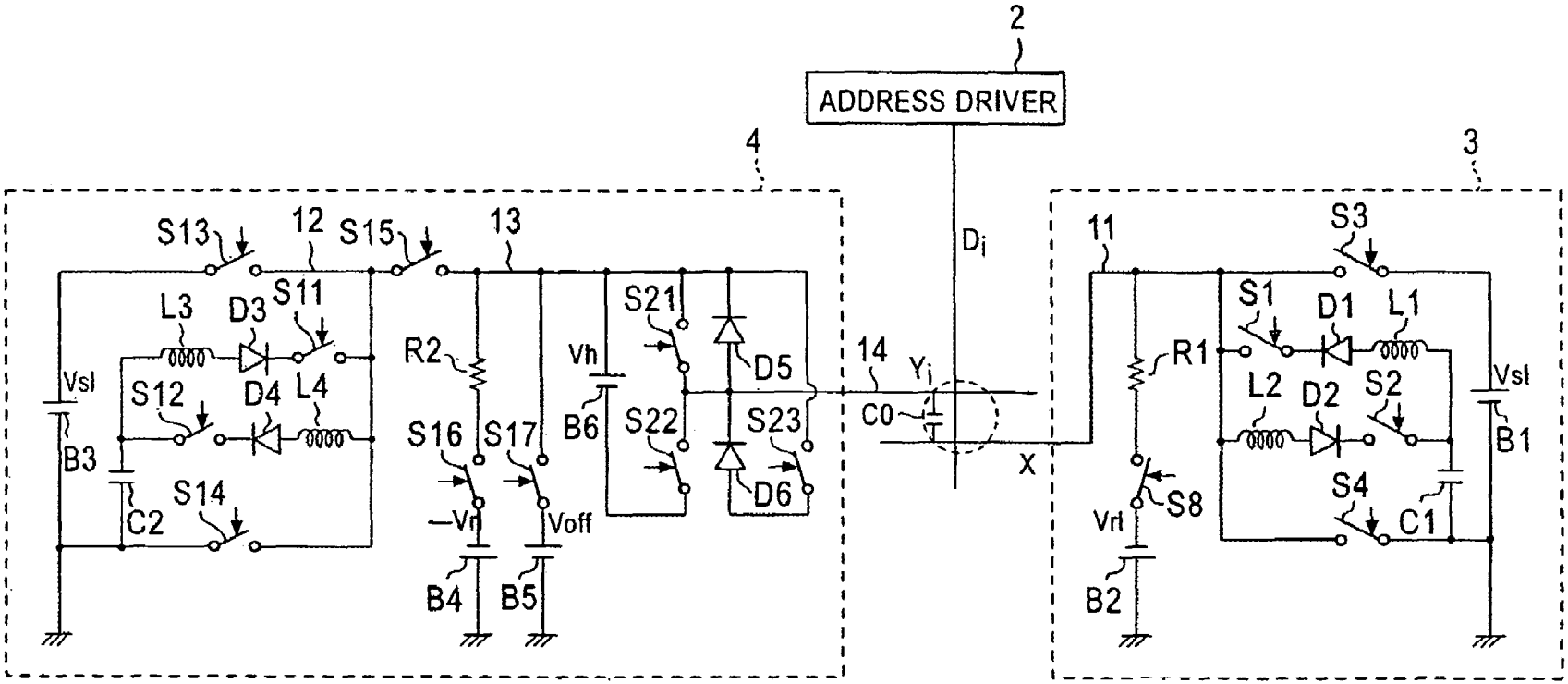
FIG. 2 PRIOR ART
FIG. 2 shows an internal construction of an X-row electrode driver 3 and a Y-row electrode driver 4 of the plasma display device shown in FIG. 1.
Figure 3:
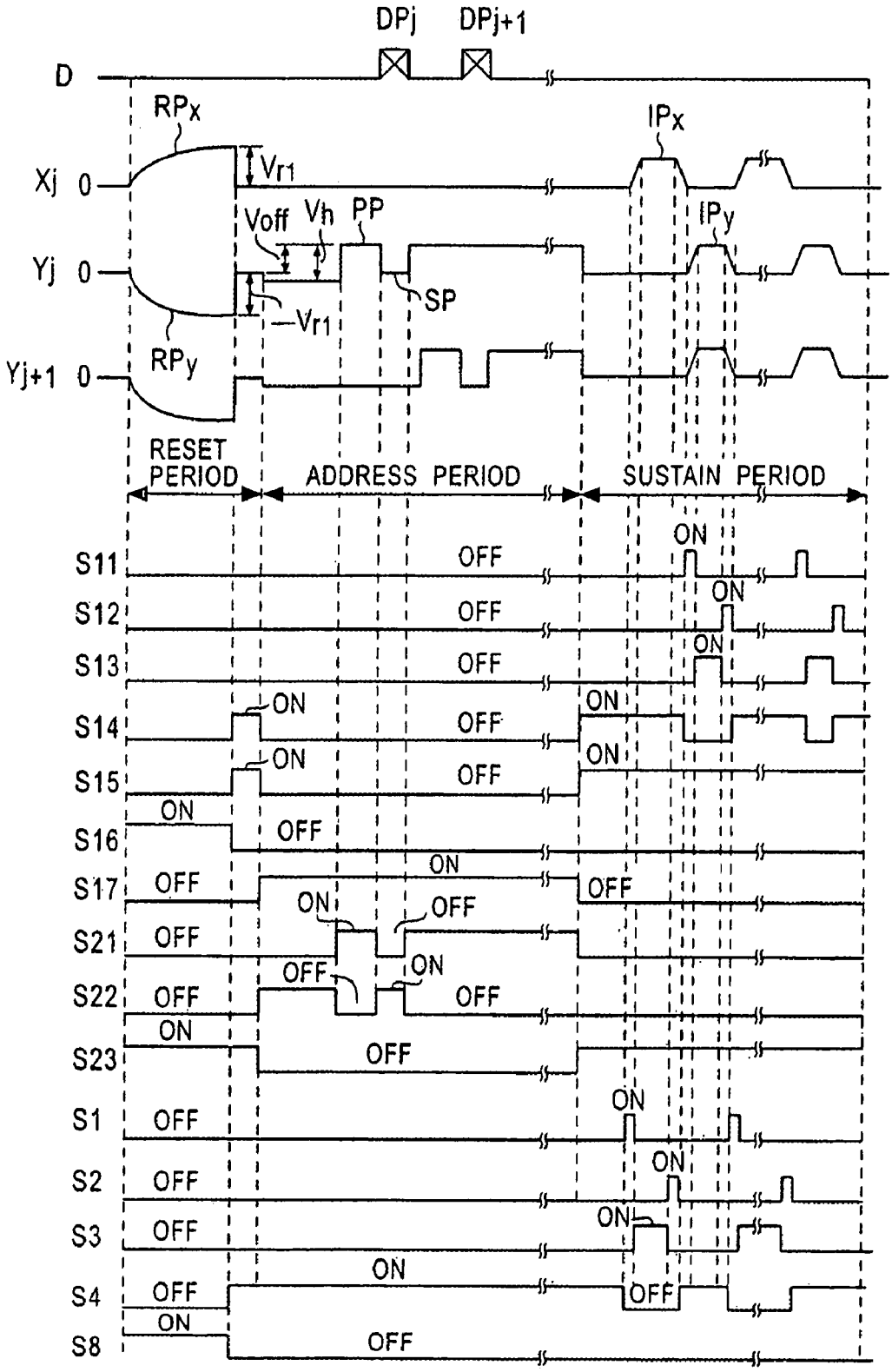
FIG. 3 PRIOR ART
FIG. 3 is a time chart showing the operations of the X-row electrode driver 3 and the Y-row electrode driver 4.
Figure 4:
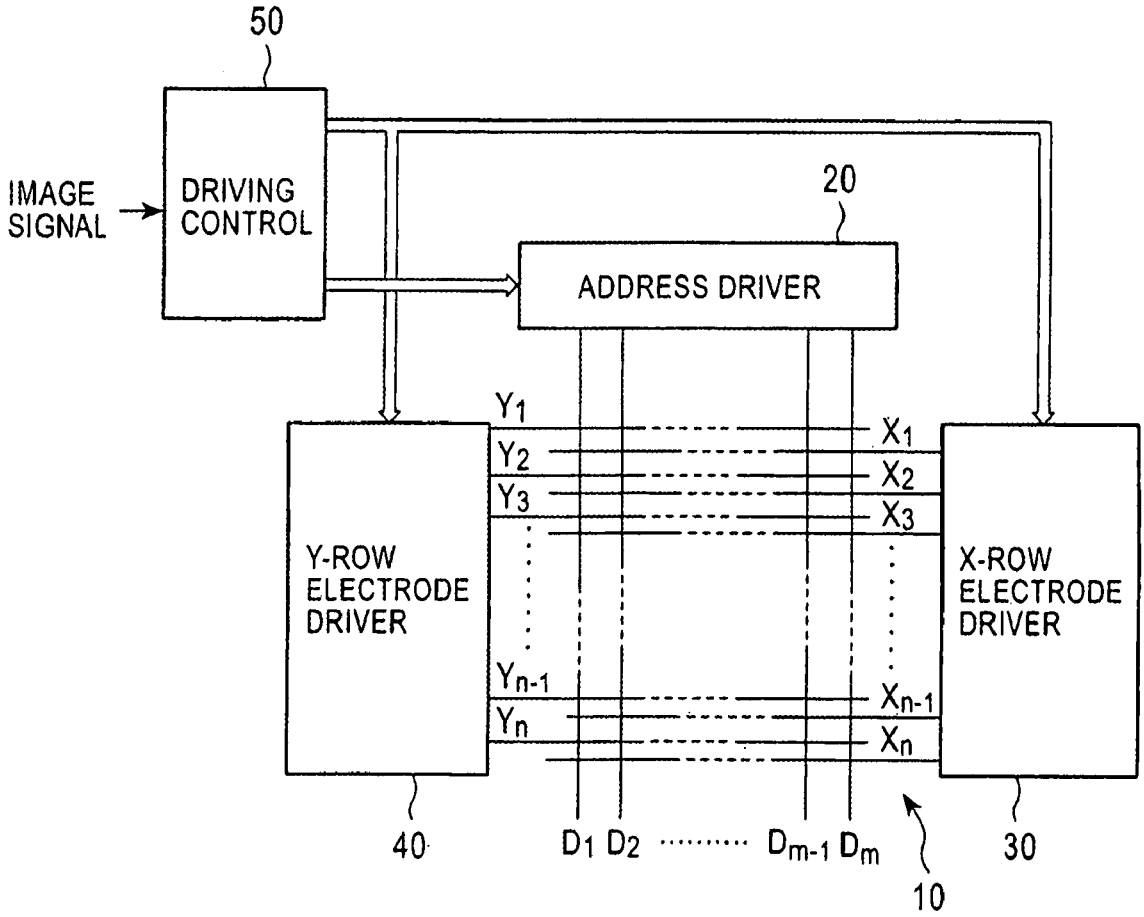
FIG. 4 shows a schematic construction of a plasma display device for driving a plasma display panel in accordance with a method for driving a display panel of the invention.

FIG. 4 shows a schematic construction of a plasma display device having a plasma display panel mounted thereto as a display panel.

Referring to FIG. 4, a PDP 10 as the plasma display panel includes row electrodes $Y_1$ to $Y_n$ and $X_1$ to $X_n$ each forming a row electrode pair by the X and Y electrodes in such a fashion as to correspond to each of the first to n-th display lines of each screen. The PDP 10 further includes column electrodes $D_1$ to $D_m$ formed in such a fashion as to intersect to the row electrode pairs and to correspond to the first to m-th columns of one screen. A dielectric layer and a discharge space are formed between these row electrode group ($Y_1$ to $Y_n$, $X_1$ to $X_n$) and column electrode group ($D_1$ to $D_m$). A discharge cell is formed, as a capacitive light emitting device, at the intersection of a pair of row electrode pair (X, Y) and a column electrode D.

Figure 5:
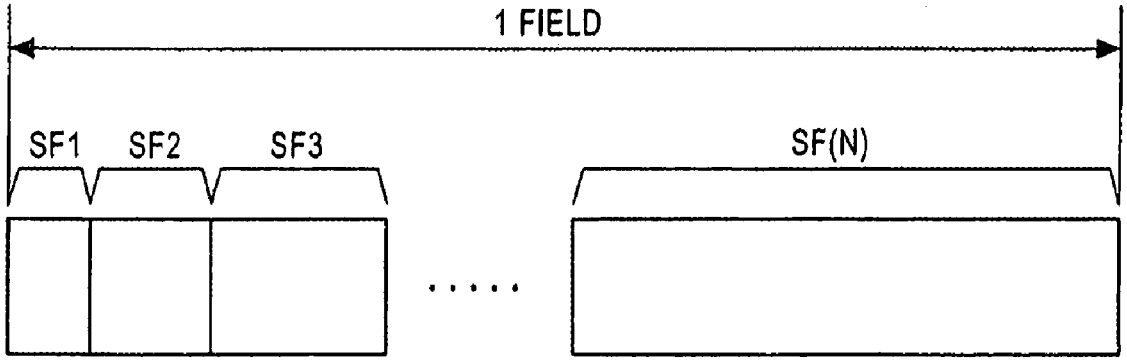
FIG. 5 shows a schematic driving format by a sub-field method.

A driving control circuit 50 converts an inputted image signal to pixel data for each pixel, divides this pixel data into bit digits corresponding to bits and acquires pixel data bits. The driving control circuit 50 supplies the pixel data bits for each display line (m bits) in the same bit digit to an address driver 20. To drive the PDP 10 in accordance with a light emission driving format based on a sub-field method shown in FIG. 5, the driving control circuit 50 further supplies various switching signals SW (to be later described) to the X-row electrode driver 30 and to the Y-row electrode driver 40. Incidentally, the sub-field method divides each field in the image signal into N sub-fields SF1 to SF(N) as shown in FIG. 5, causes light emission driving of each pixel for each sub-field for a period corresponding to weighting of each sub-field and expresses intermediate luminance.

Incidentally, the term "field" used hereby takes the image signal of an interlace system such as an NTSC system into consideration and corresponds to a frame in the image signal of a non-interlace system.

Figure 6:
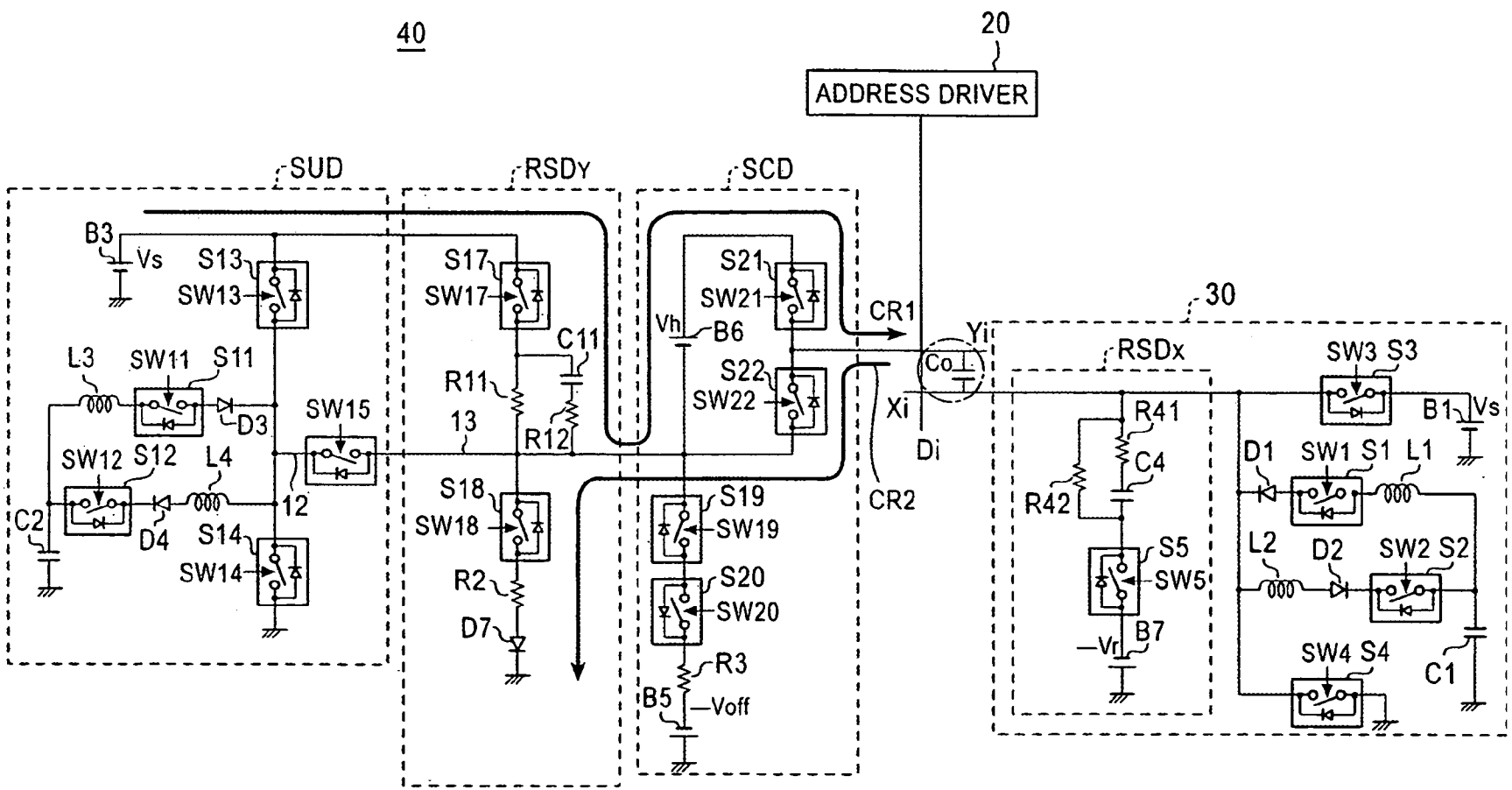
FIG. 6 shows the internal constructions of the X-row electrode driver 30 and the Y-row electrode driver 40 of the plasma display panel shown in FIG. 4.

FIG. 6 shows an internal construction of each of the X-row and Y-row electrode drivers 30 and 40.

As shown in FIG. 6, a capacitor C1 in the X-row electrode driver 30 is grounded to a PDP ground potential as a ground potential of the PDP 10 at one of its electrode terminals. A switching device S1 remains OFF while a switching signal SW1 having a logic level 0 is supplied from the driving control circuit 50. The switching device S1 is turned ON when the switching signal SW1 is at a logic level 1 and applies a voltage occurring at the other electrode terminal of the capacitor C1 to the row electrode X of the PDP 10 through a coil L1 and a diode D1. A switching device S2 remains OFF while a switching signal SW2 of the logic level 0 is supplied from the driving control circuit 50. On the other hand, the switching device S2 is turned ON when the switching signal SW2 is at the logic level 1 and supplies the voltage of the row electrode X to the other electrode terminal of the capacitor C1 through a coil L2 and a diode D2. The capacitor C1 is charged in this instance. A switching device S3 remains OFF while a switching signal SW3 having the logic level 0 is supplied from the driving control circuit 50. On the other hand, the switching device S3 is turned ON when the switching signal SW3 is at the logic level 1 and applies a voltage Vs generated by a power source B1 to the row electrode X. Incidentally, the voltage Vs is a pulse voltage of a sustain discharge pulse IPx to be later described. In other words, the power source B1 is the one that generates the voltage Vs as a pulse voltage value of the sustain discharge pulse IPx. A switching device S4 remains OFF while a switching signal SW4 of the logic level 0 is supplied from the driving control circuit 50. On the other hand, the switching device S4 is turned ON when the switching signal SW4 is at the logic level 1 and sets the row electrode X to the PDP ground potential.

The X-row electrode driver 30 further has a reset driver portion RSDx including a power source B7, a switching device S5, a capacitor C4 and resistors R41 and R42.

One of the electrode terminals of each of the resistors R41 and R42 in the reset driver portion RSDx is connected to the row electrode X. The other electrode terminal of the resistor R41 is connected to one of the electrode terminals of the capacitor C4 and the other electrode terminal of this capacitor C4 is connected to the other electrode terminal of the resistor R42. In other words, a series circuit of the resistor R41 and the capacitor C4 is connected in parallel with both terminals of the resistor R42. Incidentally, the resistor R42 has a higher resistance than the resistor R41. A switching device S5 remains OFF while a switching signal SW5 is at the logic level 0. On the other hand, the switching device S5 is turned ON when the switching signal SW5 is at the logic level 1 and applies a voltage (−Vr) of a power source B7 to the row electrode X through a circuit including the capacitor C4 and the resistors R41 and R42.

The Y-row electrode driver 40 includes a sustain driver portion SUD, a reset driver portion $RSD_y$ and a scan driver portion SCD as shown in FIG. 6.

A capacitor C2 in the sustain driver portion SUD is grounded to the PDP ground potential as the ground potential of the PDP 10 at one of its electrode terminals. A switching device S11 remains OFF while a switching signal SW11 having the logic level 0 is supplied from the driving control circuit 50. On the other hand, the switching device S11 is turned ON when the switching signal SW11 is at the logic level 1 and applies a voltage occurring at the other electrode terminal of the capacitor C2 to a connection line 12 through a coil L3 and a diode D3. A switching device S12 remains OFF while a switching signal SW12 of the logic level 0 is supplied from the driving control circuit 50. On the other hand, the switching device S12 is turned ON when the switching signal SW12 is at the logic level 1 and applies the voltage of the connection line 12 to the other electrode terminal of the capacitor C2 through the coil L4 and the diode D4. The capacitor C2 is charged in this instance by the voltage applied to the connection line 12. A switching device S13 remains OFF while a switching signal SW13 of the logic level 0 is supplied from the driving control circuit 50. On the other hand, the switching device S13 is turned ON when the switching signal SW13 is at the logic level 1 and applies the voltage Vs generated by a power source B3 to the connection line 12. Incidentally, the voltage Vs is a pulse voltage of a sustain discharge pulse IPy to be later described. In other words, the power source B1 is the one that generates the voltage Vs as a pulse voltage value of the sustain discharge pulse IPy. A switching device S14 remains OFF while a switching signal SW14 of the logic level 0 is supplied from the driving control circuit 50. On the other hand, the switching device S14 is turned ON when the switching signal SW14 is at the logic level 1 and sets the connection line 12 to the PDP ground potential. A switching device S15 is turned ON only when a switching signal SW15 supplied from the driving control circuit 50 is at the logic level 1, and connects the connection line 12 to a connection line 13.

One of the electrode terminals of each of the resistors R11 and R12 in the reset driver portion RSDy is connected to the connection line 13. The other electrode terminal of the resistor R12 is connected to one of the electrode terminals of the capacitor C11 and the other electrode terminal of this capacitor C11 is connected to the other electrode terminal of the resistor R11. In other words, a series circuit of the resistor R12 and the capacitor C11 is connected in parallel with both terminals of the resistor R11. Incidentally, the resistor R11 has a higher resistance than the resistor R12. A switching device S17 remains OFF while a switching signal SW17 is at the logic level 0. On the other hand, the switching device S17 is turned ON when the switching signal SW17 is at the logic level 1 and applies a voltage Vs of a positive terminal of the power source B3 to the connection line 13 through a circuit including the capacitor C11, the resistors R11 and R12. A switching device S18 remains OFF while a switching signal SW18 is at the logic level 0. On the other hand, the switching device S18 is turned ON when the switching signal SW18 is at the logic level 1 and grounds the connection line 13 through a resistor R2 and a diode D7.

Switching devices S19 and S20 in the scan driver portion SCD remain OFF while switching signals SW19 and SW20 of the logic level 0 are supplied from the driving control circuit 50. On the other hand, the switching devices S19 and S20 are turned ON when both of the switching signals SW19 and SW20 are at the logic level 1 and apply a voltage ($-V_{off}$) of a negative terminal of a power source B5 to the connection line 13 through a resistors R3. Incidentally, the voltage ($-V_{off}$) is a voltage bearing a pulse voltage value in a scanning pulse SP to be later described. A switching device S21 remains ON while a switching signal SW21 supplied from the driving control circuit 50 remains at the logic level 1, and connects the positive terminal of the power source B6 to the row electrode Y. A switching device S22 remains ON only while a switching signal SW22 supplied from the driving control circuit 50 is at the logic level 1, and connects the negative terminal of the power source B6 and the row electrode Y. Incidentally, the scan driver portion SCD is disposed for each of the row electrodes $Y_1$ to $Y_n$ of the PDP 10. In other words, the switching devices S21 and S22 are individually connected to each of the row electrodes $Y_1$ to $Y_n$. For example, the switching devices $S21_1$ and $S22_1$ are connected to the row electrode $Y_1$, the switching devices $S21_2$ and $S22_2$ are connected to the row electrode $Y_2$, and so on. Finally, the switching devices $S21_n$ and $S22_n$ are connected to the row electrode $Y_n$.

Next, the operation in the construction described above will be explained with reference to the timing chart in FIG. 7. Incidentally, FIG. 7 shows in extraction the operation inside one sub-field of each of the sub-fields shown in FIG. 5.

First, in a reset period, the driving control circuit 50 sets the switching device S17 in the reset driver portion $RSD_Y$ of the Y-row electrode driver 40 to ON and the switching device S22 of the scan driver portion SCD to ON. Consequently, the voltage Vs of the power source B3 in the sustain driver portion SUD is applied to the row electrode Y through the capacitor C11, the resistor R12, the connection line 13 and the switching device S22. In this instance, the load capacitance C0 of the PDP 10 is charged and the voltage of the row electrode Y gradually rises from 0 V as shown in FIG. 7. When the voltage of the row electrode Y reaches the voltage Vs after the passage of a predetermined period, the driving control circuit 50 switches the switching device S22 to OFF and the switching device S21 to ON. Consequently, a current path CR1 including the power source B3, the switching device S17, the capacitor C11, the resistor R12, the power source B6, the switching device S21 and the row electrode Y is formed, and an adding voltage (Vs+Vh) of a voltage Vh of the power source B6 adding with the voltage Vs of the power source B3 is applied to the row electrode Y. In this instance, the voltage of the row electrode Y rises more gradually than when it reaches the voltage Vs as shown in FIG. 7. Here, when the voltage of the row electrode Y reaches the voltage (Vs+Vh), the driving control circuit 50 switches the switching devices S17 and S21 to OFF and the switching devices S12, S15 and S22 to ON. Consequently, the current resulting from the charge stored in the load capacitance C0 of the PDP 10 flows into the capacitor C2 through the row electrode Y, the switching devices S22 and S15, the coil L4, the diode D4 and the switching device S12. In this instance, the capacitor C2 starts charging and the voltage of the electrode Y gradually decrease depending on the time constant of the capacitor C2 and the coil L4 (a first voltage drop period RSY1). The driving control circuit 50 switches the switching device S18 to ON and the switching devices S12 and S15 to OFF. Consequently, a current path CR2 of the switching devices S22 and S18, the resistor R2 and the diode D7 is formed. In this instance, the voltage of the electrode Y lowers more gradually than the change of the voltage in the first voltage drop period RSY1 (a second voltage drop period RSY2) depending on the time constant of the load capacitance C0 and the resistor R2.

Figure 7:
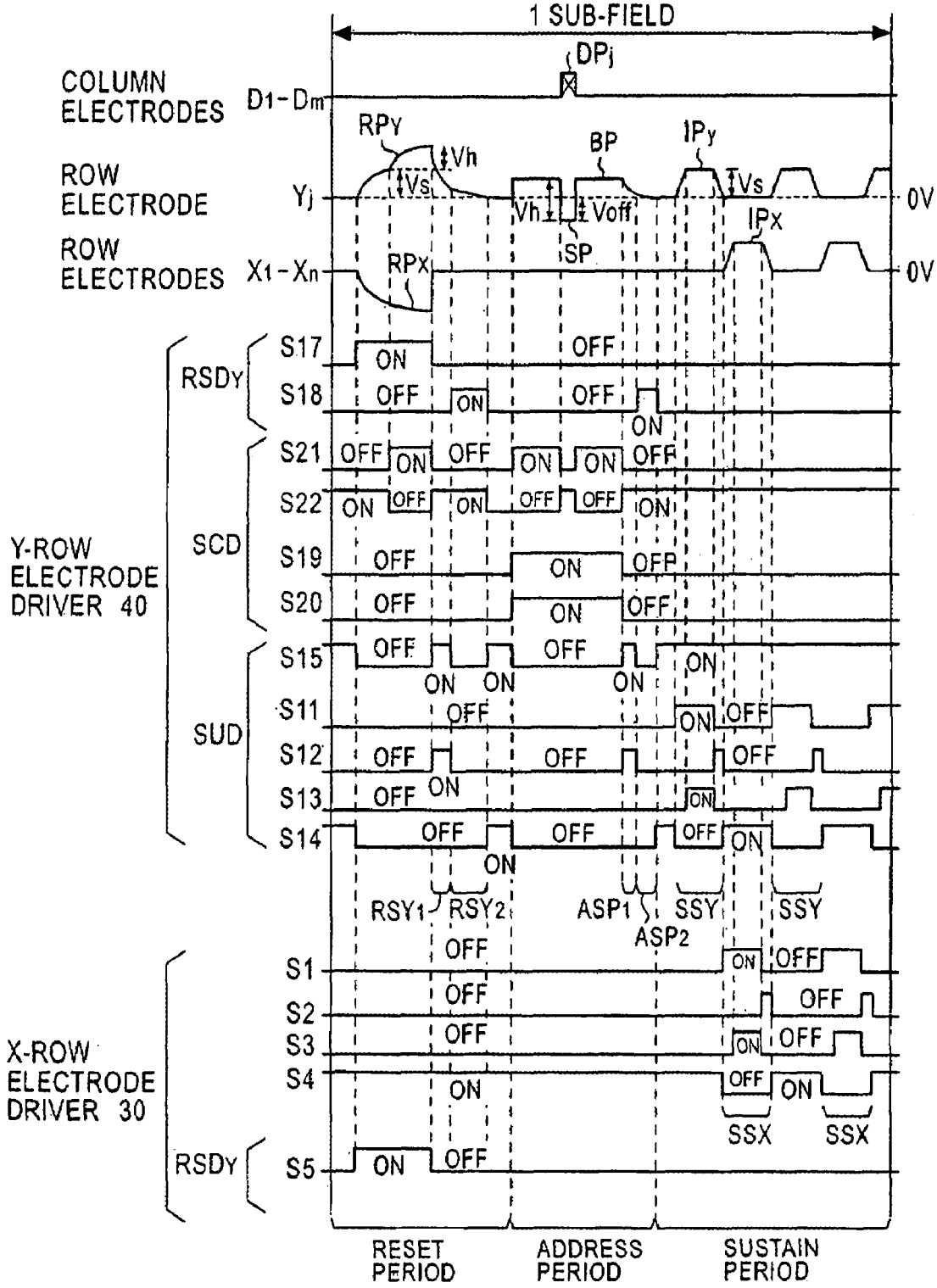
FIG. 7 is a time chart showing the operation of each of an X-row electrode driver 30 and a Y-row electrode driver 40.

As a result of a series of switching controls described above, a reset pulse $RP_y$ having a waveform shown in FIG. 7 is generated and is applied to all the row electrodes $Y_1$ to $Y_n$. The voltage of the reset pulse $RP_y$ gradually rises and reaches the maximum voltage (Vs+Vh) with the gradients of two stages and thereafter decrease gradually with the gradients of two stages.

While the switching device S17 is set to ON in the reset period shown in FIG. 7, the driving control circuit 50 sets the switching device S5 in the reset driver portion $RSD_x$ of the X-row electrode driver 30 to ON. In consequence, the voltage (−Vr) of the negative terminal of the power source B7 is applied to the row electrode X through a circuit including the switching device S5, the capacitor C4 and the resistors R41 and R42. In this instance, the voltage of the row electrode X gradually decrease from the state of 0 V as shown in FIG. 7. When the voltage of the row electrode X reaches the voltage (−Vr) described above, the driving control circuit 50 switches the switching device S5 to OFF.

Owing to the operation described above, a reset pulse $RP_x$ having a wave shape shown in FIG. 7 is generated and is applied to all the row electrodes $X_1$ to $X_n$. The voltage of the reset pulse RP gradually decrease from 0 V and reaches the minimum voltage (−Vr).

During the reset period, the reset pulse RPy having the positive polarity and the reset pulse RPx having the negative polarity are simultaneously applied as shown in FIG. 7 and reset discharge is induced inside all the discharge cells so that a wall charge having a desired quantity is formed inside each discharge cell. Consequently, all the discharge cells are initialized to a light-on mode in which sustain discharge can be made during sustain period to be described later.

Incidentally, in the embodiment shown in FIG. 7, the drop waveform of the reset pulse $RP_y$ is gentle but it may be sharp, too. For example, both switching devices S14 and S15 are set to ON instead of setting the switching device S18 to ON. Consequently, the drop waveform of the reset pulse $RP_y$ describes a waveform sharply changing from the maximum voltage (Vs+Vh) to 0 V.

During address period, the driving control circuit 50 sets the switching devices S19 to S21 of all the scan driver portions SCD disposed for each row electrode $Y_1$ to $Y_n$ to ON. Therefore, a voltage ($V_h$−$V_{off}$) of the positive polarity as the sum of the voltage (−$V_{off}$) of the negative terminal of the power source B5 and the voltage $V_h$ of the positive terminal of the power source B6 is applied to the row electrode Y. In consequence, a base pulse BP having the pulse voltage value ($V_h$−$V_{off}$) of the positive polarity shown in FIG. 7 is generated and is simultaneously applied to all the row electrodes $Y_1$ to $Y_n$. Here, the driving control circuit 50 switches selectively and serially the switching device S21 connected to each row electrode $Y_1$ to $Y_n$ to OFF and the switching device S22 connected to each row electrode $Y_1$ to $Y_n$ to ON. Consequently, the voltage of the row electrode Y serially and sharply changes from the voltage $V_h$ of the positive polarity to the voltage (−$V_{off}$) of the negative polarity. After the passage of a predetermined period, the driving control circuit 50 switches the switching device S21 to ON and the switching device S22 to OFF. In consequence, the voltage of the row electrode Y sharply changes from the voltage (−$V_{off}$) of the negative polarity to the voltage ($V_h$−$V_{off}$) of the positive polarity. As a result of a series of switching controls described above, a voltage is generated in the form in which the scan pulse SP having the voltage (−$V_{off}$) of the negative polarity overlaps with the base pulse BP having the voltage ($V_h$−$V_{off}$) of the positive polarity shown in FIG. 7 is generated and is applied selectively and serially to each row electrode $Y_1$ to $Y_n$. In the meantime, the address driver 2 applies the pixel data pulse DP corresponding to the pixel data for each pixel to the electrodes D1 to Dm by each display line (m lines) on the basis of the image signal. In this instance, discharge (selective erase discharge) is selectively induced inside the discharge cell to which the pixel data pulse DP of the high voltage simultaneously with the scan pulse SP described above and the wall discharge formed inside this discharge cell disappears. In this instance, therefore, the discharge cell is set to a light-off mode. On the other hand, the selective erase discharge is not induced inside the discharge cells to which the scan pulse SP is applied but the pixel data pulse of the high voltage is not applied. Therefore, each discharge cell keeps the state immediately before. In other words, the discharge cell in which the wall charge remains keeps the light-on mode and the discharge cell in which the wall charge does not exist keeps the light-off mode.

As described above, each discharge cell is set to either one of the light-on mode and the light-off mode during the address period in accordance with the pixel data corresponding to the input image signal.

When the application of the scan pulse SP to each row electrode $Y_1$ to $Y_n$ is finished during the address period described above, the driving control circuit 50 switches each switching device S19 to S21 from ON to OFF and each switching device S12, S15, S22 from OFF to ON. Consequently, the current resulting from the charge stored in the load capacitance C0 of the PDP 10 flows into the capacitor C2 through the row electrode Y, the switching devices S22 and S15, the coil L4, the diode D4 and the switching device S12. In this instance, the capacitor C2 starts charging and the voltage of the electrode Y gradually decrease depending on the time constant of the capacitor C2 and the coil L4 as shown in FIG. 7 (a first voltage drop period ASY1). The driving control circuit 50 switches the switching device S18 to ON and the switching devices S12 and S15 to OFF. Consequently, a current path CR2 including the switching devices S22 and S18, the resistor R2 and the diode D7 is formed. In this instance, the voltage of the electrode Y decrease more gradually than the change in the first voltage drop period ASY1 depending on the time constant of the load capacitance C0 and the resistor R2 (a second voltage drop period ASY2). In other words, the fall period of the voltage value of the base pulse BP applied to all the row electrodes Y during the address period shown in FIG. 7 includes the first voltage drop period ASY1 and the second voltage drop period ASY2. This means that the change ratio of the voltage value of the base pulse BP in the fall period is smaller than the change ratio of the voltage value in the fall period in the scan pulse SP.

During sustain period, the driving control circuit 50 first switches the switching device S14 of the sustain driver portion SUD from OFF to ON and after the passage of a predetermined period, switches the switching device S15 of the sustain driver portion SUD from OFF to ON. The driving control circuit 50 interruptedly repeats switching setting SSY shown in FIG. 7 for each of the switching devices S11 to S14 of the sustain driver portion SUD. Furthermore, the driving control circuit 50 interruptedly repeats switching setting SSX shown in FIG. 7 for each of the switching devices S1 to S4 of the X-row electrode driver 30. Incidentally, the driving control circuit 50 repeatedly executes switching setting SSY and SSX the number of times corresponding to weighting of each sub-field during the sustain period of each sub-field.

In switching setting SSX, only the switching device S1 among the switching devices S1 to S4 is turned ON and the current resulting from the charge stored in the capacitor C1 flows into the discharge cell through the coil L1, the diode D1 and the row electrode X. Consequently, the voltage of the row electrode X gradually rises as shown in FIG. 7. Next, the switching device S3 is turned ON with the switching device S1 and the voltage $V_s$ of the power source B1 is as such applied to the row electrode X, so that the voltage of the row electrode X is fixed at the voltage $V_s$. Then, only the switching device S2 among the switching devices S1 to S4 is turned ON and the current resulting from the charge stored in the load capacitance $C_0$ between the row electrodes X and Y flows into the capacitor C1 through the row electrode X, the coil L2 and the diode D2. In consequence, the voltage of the row electrode X gradually decrease as shown in FIG. 7. As this switching setting SSX is interruptedly repeated, a sustain discharge pulse IPx having the voltage Vs shown in FIG. 7 as the pulse voltage value is generated and is repeatedly applied to the row electrode X.

In switching setting SSY, only the switching device S11 among the switching devices S11 to S14 and S17 to S22 is first turned ON and the current resulting from the charge stored in the capacitor C2 flows into the discharge cell through the coil L3, the diode D3, the switching device S15, the switching device S22 and the row electrode Y. Consequently, the voltage of the row electrode Y gradually rises as shown in FIG. 7. Next, the switching device S13 is turned ON with the switching device S11 and the voltage $V_s$ of the power source B3 is applied to the row electrode Y through the switching device S15 and the switching device S22. Consequently, the voltage of the row electrode Y is fixed at the voltage $V_s$ as shown in FIG. 7. Then, only the switching device S12 among the switching devices S11 to S14 and only the switching device S22 among the switching devices S17 to S22 are turned ON and the current resulting from the charge stored in the load capacitance $C_0$ between the row electrodes X and Y flows into the capacitor C1 through the row electrode Y, the switching devices S22 and S15, the coil L4 and the diode D4. In consequence, the voltage of the row electrode Y gradually decrease as shown in FIG. 7. As this switching setting SSY is interruptedly repeated, a sustain discharge pulse $IP_y$ having the voltage Vs shown in FIG. 7 as the pulse voltage value is generated and is repeatedly applied to the row electrode Y.

During the sustain period, only the discharge cell in which the wall charge exists, that is, only the discharge cell set to the light-on mode as described above, causes discharge (sustain discharge) whenever the sustain discharge pulses $IP_x$ and $IP_y$ are applied thereto, and repeats emission of light with the discharge. In other words, only the discharge cell set to the light-on mode repeats light emission the number of times corresponding to weighting of the sub-field during the sustain period of each sub-field.

In the driving operation shown in FIG. 7, the base pulse BP having the same polarity as the pixel data pulse is applied to all the row electrodes $Y_1$ to $Y_n$ during the address period. In this way, so-called "erroneous discharge" in which discharge is erroneously induced between the row electrode Y to which the scan pulse SP is not applied and the column electrode D is prevented. In this instance, the change ratio of the voltage value in the base pulse BP in the fall period is set to a smaller value than the change ratio of the voltage value in the fall period in the scan pulse SP in the driving operation shown in FIG. 7. In other words, the change of the voltage value at the rear edge portion in the base pulse BP is set to be more gentle than the change of the voltage value at the edge portion in the scan pulse SP. In comparison with the case where the change of the voltage value at the rear edge portion in the base pulse BP is sharp, therefore, the amount of noise occurring at this rear edge portion much more decreases. In this instance, because also the quantity of the current flowing into the driver IC with such a noise becomes smaller, durability of the driver IC can be improved to a higher level.

This application is based on a Japanese patent application No. 2003-199874 which is hereby incorporated by reference.

What is claimed is:

1. A method for driving a display panel having discharge cells each arranged at a point of intersection between each of a plurality of row electrode pairs corresponding to display lines and each of a plurality of column electrodes so arranged as to intersect said row electrode pairs, for each of a plurality of sub-fields constituting each field of an image signal, wherein:

each of said sub-fields includes an address period in which a scan pulse is applied in superposition with a base pulse to one of the row electrodes of one of said row electrode pairs while the base pulse is applied to one of the row electrodes of all of said row electrode pairs, and said discharge cells are selectively caused to discharge and are set to either one of a light-on mode and a light-off mode by applying a pixel data pulse corresponding to said image signal at the same application time as that of said scan pulse to the column electrode, and each of said sub-fields includes a sustain period in which a sustain pulse is applied the number of times corresponding to weighting of said sub-field to said row electrode pairs so that only said discharge cells set to said light-on mode are allowed to repeatedly cause sustain discharge; and wherein:

a fall period of a voltage value in said base pulse includes a first voltage drop period in which the voltage value gradually decreases at a first change ratio and a second voltage drop period which succeeds the first voltage drop period and in which the voltage value gradually decreases at a second change ratio different from said first change ratio.

2. A method for driving a display panel according to claim 1, wherein said second change ratio is smaller than said first change ratio.

* * * * *